US008778139B2

(12) United States Patent
Esser et al.

(10) Patent No.: US 8,778,139 B2
(45) Date of Patent: Jul. 15, 2014

(54) PAPERS WITH A HIGH FILLER MATERIAL CONTENT AND HIGH DRY STRENGTH

(75) Inventors: Anton Esser, Limburgerhof (DE); Hans-Joachim Haehnle, Neustadt (DE); Tibor Adalbert Von Vadkerthy, Singapore (SG)

(73) Assignee: BASF Aktiengesellschaft, Ludwigshafen (DE)

( * ) Notice: Subject to any disclaimer, the term of this patent is extended or adjusted under 35 U.S.C. 154(b) by 1224 days.

(21) Appl. No.: 11/721,929

(22) PCT Filed: Dec. 14, 2005

(86) PCT No.: PCT/EP2005/013430

§ 371 (c)(1),
(2), (4) Date: Jun. 15, 2007

(87) PCT Pub. No.: WO2006/066769

PCT Pub. Date: Jun. 29, 2006

(65) Prior Publication Data

US 2009/0272506 A1 Nov. 5, 2009

(30) Foreign Application Priority Data

Dec. 17, 2004 (DE) ..... 10 2004 061 605
May 12, 2005 (DE) ..... 10 2005 022 799

(51) Int. Cl.
*D21H 17/52* (2006.01)

(52) U.S. Cl.
USPC ..... 162/164.3

(58) Field of Classification Search
None
See application file for complete search history.

(56) References Cited

U.S. PATENT DOCUMENTS

| | | | | |
|---|---|---|---|---|
| 4,774,285 | A | 9/1988 | Pfohl et al. | |
| 5,008,321 | A * | 4/1991 | Hartmann et al. | 524/378 |
| 5,145,559 | A | 9/1992 | Auhorn et al. | |
| 6,033,524 | A * | 3/2000 | Pruszynski et al. | 162/165 |
| 6,057,404 | A * | 5/2000 | Utecht et al. | 525/328.2 |
| 6,132,558 | A * | 10/2000 | Dyllick-Brenzinger et al. | 162/164.6 |
| 7,034,068 | B1 | 4/2006 | Negele et al. | |
| 2002/0088579 | A1 | 7/2002 | Forsberg et al. | |
| 2005/0061461 | A1 | 3/2005 | Linhart et al. | |

FOREIGN PATENT DOCUMENTS

| | | |
|---|---|---|
| DE | 103 34 133 | 2/2005 |
| JP | 62-074902 | 4/1987 |
| JP | 04-281094 | 10/1992 |
| JP | 05-106103 | 4/1993 |
| JP | 8 59740 | 3/1996 |
| JP | 2002-529554 | 9/2002 |
| JP | 2004-018323 | 1/2004 |
| JP | 2004-018336 | 1/2004 |
| WO | WO 00/49227 | 8/2000 |
| WO | 01 86067 | 11/2001 |
| WO | WO 03/052205 | 6/2003 |
| WO | 2004 087818 | 10/2004 |

* cited by examiner

*Primary Examiner* — Jacob Thomas Minskey
(74) *Attorney, Agent, or Firm* — Oblon, Spivak, McClelland, Maier & Neustadt, L.L.P.

(57) ABSTRACT

A process for producing paper, board and cardboard in the presence of an aqueous slurry of components comprising finely divided fillers coated at least partly with water-soluble amphoteric copolymers, which involves adding, further to the aqueous slurry of components comprising finely divided fillers, at least one cationic and/or amphoteric polymer comprising as structural element no esters of unsaturated carboxylic acids with quaternized amino alcohols to the fiber suspension prior to sheet forming.

18 Claims, No Drawings

PAPERS WITH A HIGH FILLER MATERIAL CONTENT AND HIGH DRY STRENGTH

The present invention relates to a process for producing papers of high filler content and high dry strength, and to the papers produced by this process.

In the papermaking art numerous assistants are added to the fiber suspension. Fillers., for example, are added to the fiber suspension, which is particularly advantageous when the filler is cheaper than the fiber. In that case the addition, or increased addition, of filler may lead to a reduction in the fiber fraction and hence to a reduction in the paper's production costs. Filled papers, or papers with a particularly high filler content, are easier to dry than unfilled papers or papers with a lower filler content. Consequently the paper machine can be operated at higher speed and with lower steam consumption, which both raises productivity and lowers costs.

In the production of filled papers the filler slurry is added to the fiber suspension before the latter is passed forward to the former of the paper machine. A retention aid or retention aid system is generally added to the filler/fiber suspension in order that as much filler as possible is retained in the paper sheet. Adding the filler to the paper gives the papermaker the facility to achieve numerous improvements in sheet properties. These include properties such as opacity, whiteness, tactility and printability.

However, the addition of filler to the fiber suspension is also accompanied by disadvantages, which can be compensated only partly by adding further assistants. For a given basis weight there are limits on the amount of filler that can be employed. The strength properties of the paper are normally the most important parameters limiting the amount of filler in the paper. Other factors too, such as filler retention, drainage of the paper stock suspension, and a possible increase in chemical consumption for retention and sizing, may play a part here.

The loss of strength properties in papers can be compensated in some cases entirely or partially through the use of dry and wet strength agents. One common procedure in this case is to add cationic starch as a dry strength agent to the paper stock. Synthetic dry and wet strength agents, too, are used, based for example on cationic or anionic polyacrylamides. The amount of the addition and the strengthening effect, however, are limited in the majority of cases. Equally, the compensating effect is limited in relation to the loss of strength due to increased filler, and so the increase in filler which can be realized anyway is also limited. Furthermore, not all strength properties are increased to an equal extent, and in some cases such properties are not adequately increased at all, through the use of dry strength agents. One important example of this is the tear propagation energy, which in comparison to other strength parameters is influenced only slightly through the use of starch or synthetic dry strength agents. Increasing the filler content of the paper, on the other hand, generally has a very sharply negative influence on the tear propagation energy.

Further important properties are the thickness and stiffness of the paper. With a given basis weight, increasing the filler content results in a decrease in paper density and in the thickness of the paper sheet. The latter leads to a considerable reduction in paper stiffness. This reduction in paper stiffness can in many cases not be compensated solely through the use of dry strength agents. Frequently, additional measures, such as, for instance, reducing the mechanical pressure in the press section in the smoothing rolls, in calenders or in the dry section of the paper machine, are necessary. The latter provides full or partial compensation for the loss of thickness due to increased filler.

A number of filler systems have been described in the literature. WO 01/86067discloses the modification of fillers with hydrophobic polymers, wherein the filler particles are coated with the hydrophobic polymers. The hydrophobic polymers of WO 01/86067 contain starch. The papers produced therewith feature improved properties such as wet strength.

From JP-A 08059740 it is known that amphoteric, water-soluble polymers are added to aqueous suspensions of inorganic particles, with at least part of the polymers being adsorbed on the filler surface. The amphoteric polymers are prepared preferably by hydrolyzing copolymers of N-vinylformamide, acrylonitrile and acrylic acid in the presence of acids. They comprise 20 to 90 mol % of amidine units of the structure (I)

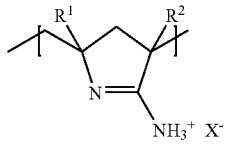

in which $R^1$ and $R^2$ are each H or a methyl group and $X^-$ is an anion, in the production of filled papers, the filler slurries treated with such polymers are added to the paper stock. The filler treatment leads to improvement in the draining of the paper stock and also gives rise to an improvement in various strength properties of the dried paper, and also an improvement in filler retention.

US-A 2002/0088579 describes the pretreatment of inorganic fillers with cationic, anionic and amphoteric (zwitterionic) polymers. This treatment consists in each case of at least two stages. Recommended first is treatment with a cationic polymer, and subsequently treatment with an anionic polymer. In further steps, further cationic and anionic polymers can be adsorbed again in alternation. In the production of filled paper, the aqueous suspensions with the pretreated filler particles are added to the paper stock. Filler treatment leads to an improvement in various strength properties of the dried paper.

WO 04/087818 describes aqueous slurries of finely divided fillers which are at least partly coated with polymers and are obtainable by treating aqueous slurries of finely divided fillers with at least one water-soluble amphoteric copolymer itself obtainable by copolymerizing a) at least one N-vinylcarboxamide of the formula (II)

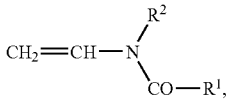

where $R^1$ and $R^2$ are H or $C_1$ to $C_6$ alkyl, b) at least one monoethylenically unsaturated carboxylic acid having 3 to 8 carbon atoms in the molecule and/or the alkali metal, alkaline earth metal or ammonium salts thereof, and if appropriate c) other monoethylenically unsaturated monomers, which are free from nitrile groups, and if appropriate d) compounds having at least two ethylenically unsaturated double bonds per molecule, and subsequently eliminating some or all of the groups —CO—$R^1$ from the monomers II incorporated in the form of copolymerized units in the copolymer.

Known from DE 103 34 133 A1 are aqueous compositions comprising at least one finely divided filler and at least one water-soluble amphoteric copolymer obtainable by copolymerizing a monomer mixture comprising a) at least one N-vinylcarboxamide of the general formula

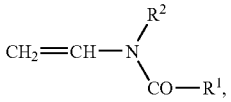

(II)

where $R^1$ and $R^2$ independently of one another are H or $C_1$ to $C_6$ alkyl, b) at least one monomer selected from monoethylenically unsaturated sulfonic acids, phosphonic acids, phosphoric esters, and derivatives thereof, c) if appropriate at least one monomer selected from monoethylenically unsaturated monocarboxylic and dicarboxylic acids, salts thereof, and dicarboxylic anhydrides, d) if appropriate at least one monoethylenically unsaturated monomer which is different than components a) to c) and is free from nitrile groups, and e) if appropriate at least one compound having at least two ethylenically unsaturated double bonds per molecule, with the proviso that the monomer mixture comprises at least one monomer b) or c) having at least one free acid group and/or one acid group in salt form, and subsequently hydrolyzing some or all of the groups —CO—$R^1$ from the monomers II incorporated in the form of copolymerized units in the copolymer.

The filler systems known from the literature are united by the fact that they allow papers with a limited filler content to be produced. Moreover, the typical paper properties such as dry strength are deserving of improvement.

The object was therefore to provide a process for producing paper of high filler content and high dry strength. The papers produced thereby ought to be distinguished by improved performance properties, and particularly by good strength properties on the part of the dried paper. Such properties include, in particular, good dry breaking lengths, tear propagation energy, bending stiffness, and internal strength. The papers produced ought, furthermore, to have a higher filler content than that known from the prior art.

This object has been achieved by means of a process for producing paper, board and cardboard in the presence of an aqueous slurry of components comprising finely divided fillers coated at least partly with water-soluble amphoteric copolymers, which involves adding, further to the aqueous slurry of components comprising finely divided fillers, at least one cationic and/or amphoteric polymer comprising as structural element no esters of unsaturated carboxylic acids with quaternized amino alcohols to the fiber suspension prior to sheet forming.

By components comprising finely divided fillers for the purposes of the present invention are meant not only finely divided fillers alone, i.e., in pure form, or as what is known as fresh filler, but also raw materials comprising finely divided fillers, such as the broke, as it is known, from coated paper, and also mixtures thereof in any desired composition.

In general the aqueous slurry of the components comprising finely divided fillers is metered to the fiber suspension before said suspension is passed to the former of the paper machine.

The cationic and/or amphoteric polymers can be metered at various sites in the papermaking operation. Consideration may be given to metering into the high-consistency pulp area, but also to metering into the low-consistency pulp of the fiber suspension. Divided addition at different sites in the production operation is a further possibility.

Preferably, however, the at least one cationic and/or amphoteric polymer is added to the fiber suspension immediately after the addition of the aqueous slurry of components comprising finely divided fillers. Immediately means that there is no further process step between the meterings of the components, i.e., no metering of other papermaking assistants or, for example, no acting of shearing forces on the suspension.

The cationic and/or amphoteric polymer comprises no structural elements of esters of unsaturated carboxylic acids, $C_3$-$C_8$ carboxylic acids for example, with quaternized amino alcohols, N,N,N-trimethylammonioethanol for example.

The cationic and/or amphoteric polymer is selected from homo- and copolymers of vinylimidazoles, diallylalkylamines and allyldialkylamines, these monomers being used in neutral form, as salts of acids, or in quaternized form, homo- and copolymers of esters of unsaturated carboxylic acids with N,N-dialkylamino alcohols or N-alkylamine alcohols, these monomers being used in neutral form or as salts of acids, homo- and copolymers of amides of unsaturated carboxylic acids with N,N-dialkyldiamines or N-alkyldiamines, these monomers being used in neutral form, as salts of acids, or in quaternized form, condensation products of epichlorohydrin or bisepoxides with dialkylamines or polyamidoamines.

polyethyleneimines, grafting products of ethyleneimines onto amidoamines or polyamines, cationic starches and/or polymers comprising vinylamine units.

Homo- and copolymers of vinylimidazoles, diallylalkylamines having alkyl groups of $C_1$-$C_{10}$, preferably $C_1$-$C_6$, and allyldialkylamines having alkyl groups of $C_1$-$C_{10}$, preferably $C_1$-$C_6$, the alkyl groups being identical or different, and these monomers being used in neutral form, as salts of acids, or in quaternized form, are based typically on the monomers N-vinylimidazole, dimethyldiallylammonium chloride, and dimethylallylamine.

Homo- and copolymers of esters of unsaturated carboxylic acids having 3 to 8 carbon atoms with N,N-dialkylamino alcohols having alkyl groups of $C_1$-$C_{10}$, preferably $C_1$-$C_6$, the alkyl groups being identical or different, or N-alkylamino alcohols with alkyl groups of $C_1$-$C_{10}$, preferably $C_1$-$C_6$, these monomers being used in neutral form or as salts of acids, are based for example on esters of acrylic acid or methacrylic acid with N,N-dimethylaminoethylamine.

Homo- and copolymers of amides of unsaturated carboxylic acids having 3 to 8 carbon atoms with N,N-dialkyldiamines having alkyl groups of $C_1$-$C_{10}$, preferably $C_1$-$C_6$, the alkyl groups being identical or different, or N-alkyldiamines with alkyl groups of $C_1$-$C_{10}$, preferably $C_1$-$C_6$, these monomers being used in neutral form, as salts of acids, or in quaternized form, are based for example on amides of acrylic acid and methacrylic acid with N,N-dimethylaminoethyleneamine, 3-(N,N-dimethylamino)propylamine or 3-(N,N,N-trimethylammonio)propylamine.

Condensation products of epichlorohydrin or bisepoxides with dialkylamines having alkyl groups of $C_1$-$C_{10}$, preferably $C_1$-$C_6$, the alkyl groups being identical or different, or polyamidoamines may likewise be used. Examples of typical representatives include Catiofast® PR 8153 and Catiofast® PR 8154 from BASF Aktiengesellschaft, which are commonly used as fixing agents in the paper industry.

Polyethyleneimines are disclosed for example in WO 97/25367 and in the literature cited therein.

Grafting products of ethyleneimines onto amidoamines or polyamines are, for example, the nitrogen-containing condensation products described in German laid-open specification DE 24 34 816.

Cationic starches are disclosed for example in Günther Tegge, Stärke und Stärkederivate, Behr's-Verlag, Hamburg, 1984, They comprise, for example, potato starch, corn starch, wheat starch, rice starch, tapioca starch, sago starch, manioc starch, and rye starch. These starches are reacted for example with 2,3-(epoxy)propyltrimethyl-ammonium chloride.

Polymers comprising vinylamine units, such as are used for the purposes of the present invention, are known; cf. U.S. Pat. Nos. 4,421,602, 5,334,287, EP-A 216 387, U.S. Pat. No. 5,981,689, WO 00/63295, U.S. Pat. Nos. 6,121,409 and 6,132,558. They are prepared by hydrolyzing polymers comprising open-chain N-vinylcarboxamide units. These polymers are obtainable, for example, by polymerizing N-vinylformamide, N-vinyl-N-methylformamide, N-vinylacetamide, N-vinyl-N-methylacetamide, N-vinyl-N-ethylacetamide and N-vinylpropionamide. The stated monomers can be polymerized either alone or together with other monomers. Preference is given to N-vinylformamide.

Suitable monoethylenically unsaturated monomers copolymerized with the N-vinylcarboxamides are all compounds which can be copolymerized with them. Examples of such are vinyl esters of saturated carboxylic acids of 1 to 6 carbon atoms, such as vinyl formate, vinyl acetate, N-vinylpyrrolidone, vinyl propionate and vinyl butyrate, and vinyl ethers such as $C_1$-to $C_6$ alkyl vinyl ethers, e.g., methyl or ethyl vinyl ether. Further suitable comonomers are esters of alcohols having for example 1 to 6carbon atoms, amides and nitriles of ethylenically unsaturated $C_3$-to $C_6$ carboxylic acids, methyl acrylate, methyl methacrylate, ethyl acrylate, ethyl methacrylate and dimethyl maleate for example, acrylamide and methacrylamide, and acrylonitrile and methacrylonitrile.

Further suitable carboxylic esters derive from glycols, or polyalkylene glycols, in each of which only one OH group is esterified: for example, hydroxyethyl acrylate, hydroxyethyl methacrylate, hydroxypropyl acrylate, hydroxybutyl acrylate, hydroxypropyl methacrylate and hydroxybutyl methacrylate, and also acrylic monoesters of polyalkylene glycols with a molar mass of 500 to 10 000. Further suitable comonomers are esters of ethylenically unsaturated carboxylic acids with amino alcohols, such as dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, dimethylaminobutyl acrylate, and diethylaminobutyl acrylate, for example. The basic acrylates can be used in the form of the free bases, the salts with mineral acids such as hydrochloric, sulfuric or nitric acid, the salts with organic acids such as formic, acetic or propionic acid, or the sulfonic acids, or in quaternized form. Examples of suitable quaternizing agents include dimethyl sulfate, diethyl sulfate, methyl chloride, ethyl chloride or benzyl chloride.

Further suitable comonomers are amides of ethylenically unsaturated carboxylic acids such as acrylamide, methacrylamide and also N-alkyl monoamides and diamides of monoethylenically unsaturated carboxylic acids having alkyl radicals of 1 to 6 carbon atoms, examples being N-methylacrylamide, N,N-dimethylacrylamide, N-methylmethacrylamide, N-ethylacrylamide, N-propylacrylamide and tert-butylacrylamide, and also basic (meth)acrylamides, such as dimethylaminoethylacrylamide, dimethylaminoethylmethacrylamide, diethylaminoethylacrylamide, diethylaminoethylmethacrylamide, dimethylaminopropylacrylamide, diethylaminopropylacrylamide, dimethylaminopropylmethacrylamide and diethylaminopropylmethacrylamide, for example.

Further suitable comonomers include N-vinylpyrrolidone, N-vinylcaprolactam, acrylonitrile, methacrylonitrile, N-vinylimidazole and also substituted N-vinylimidazoles such as, for example, N-vinyl-2-methylimidazole, N-vinyl-4-methylimidazole, N-vinyl-5-methylimidazole, N-vinyl-2-ethylimidazole and N-vinylimidazolines such as N-vinylimidazoline, N-vinyl-2-methylimidazoline and N-vinyl-2-ethylimidazoline. As well as the free base form, N-vinylimidazoies and N-vinylimidazolines are also used in the form in which they are neutralized with mineral acids or organic acids, or in quaternized form, with quaternization being undertaken preferably with dimethyl sulfate, diethyl sulfate, methyl chloride or benzyl chloride. Also suitable are diallyldialkylammonium halides such as diallyldimethylammonium chloride, for example.

The copolymers comprise for example

- 95 to 5 mol %, preferably 90 to 10 mol %, of at least one N-vinylcarboxamide, preferably N-vinylformamide, and
- 5 to 95 mol %, preferably 10 to 90 mol %, of monoethylenically unsaturated monomers in copolymerized form. The comonomers are preferably free from acid groups.

The monomers are normally polymerized in the presence of free-radical polymerization initiators. The homopolymers and copolymers can be obtained by any known methods; by way of example they are obtained by solution polymerization in water, alcohols, ethers or dimethylformamide, or in mixtures of various solvents, by precipitation polymerization, by inverse suspension polymerization (polymerizing an emulsion of a monomer-containing aqueous phase in an oil phase), and polymerization of a water-in-water emulsion—in which case, for example, an aqueous monomer solution is dissolved or emulsified in an aqueous phase and is polymerized to form an aqueous dispersion of a water-soluble polymer, as described for example in WO 00/27893. Following the polymerization the homopolymers and copolymers, which comprise copolymerized N-vinylcarboxamide units, are fully or partly hydrolyzed as described below.

In order to prepare polymers comprising vinylamine units it is preferred to start from homopolymers of N-vinylformamide or from copolymers obtainable by copolymerizing

- N-vinylformamide with
- vinyl formate, vinyl acetate, vinyl propionate, acrylonitrile, methyl acrylate, ethyl acrylate and/or methyl methacrylate and subsequently hydrolyzing the homopolymers or copolymers to form vinylamine units from the copolymerized N-vinylformamide units, the degree of hydrolysis being for example 1 to 100 mol %, preferably 25 to 100 mol %, more preferably 50 to 100 mol %, and with particular preference 70 to 100 mol %. The degree of hydrolysis corresponds to the vinylamine group content of the polymers in mol %. The polymers described above are hydrolyzed by known methods, by the action of acids (e.g., mineral acids such as sulfuric, hydrochloric or phosphoric acid, carboxylic acids such as formic or acetic acid, or sulfonic or phosphonic acids), bases or enzymes, as described for example in DE-A 31 28 478 and U.S. Pat. No. 6,132,558. When acids are used as hydrolysis agents the vinylamine units of the polymers are in ammonium salt form, whereas hydrolysis with bases produces the free amino groups.

In the majority of cases the degree of hydrolysis of the homopolymers and copolymers used is 85 to 95 mol %. The degree of hydrolysis of the homopolymers is synonymous with the vinylamine unit content of the polymers. In the case of copolymers which comprise vinyl esters in copolymerized form, hydrolysis of the N-vinylformamide units may be accompanied by hydrolysis of the ester groups, with the formation of vinyl alcohol units. This is especially the case when the copolymers are hydrolyzed in the presence of sodium hydroxide solution. Copolymerized acrylonitrile is likewise chemically modified during the hydrolysis. This gives rise, for example, to amide groups or carboxyl groups. The homopolymers and copolymers comprising vinylamine units may if appropriate comprise up to 20 mol % of amidine units, formed for example by reaction of formic acid with two adjacent amino groups or by intramolecular reaction of an amino group with an adjacent amide group—that of copolymerized N-vinylformamide, for example.

The average molar masses $M_w$ of the polymers comprising vinylamine units amount for example to 500 to 10 million, preferably 750 to 5 million and more preferably 1000 to 2 million g/mol (determined by light scattering). This molar mass range corresponds, for example, to K values of 30 to 150, preferably 60 to 100 (determined in accordance with H. Fikentscher in 5% strength aqueous sodium chloride solution at 25° C., a pH of 7 and a polymer concentration of 0.5% by weight). Particular preference is given to using polymers comprising vinylamine units and having K values of 85 to 95.

The polymers comprising vinylamine units have, for example, a charge density (determined at a pH of 7) of 0 to 18 meq/g, preferably of 5 to 18 meq/g and in particular of 10 to 16 meq/g.

The polymers comprising vinylamine units are preferably used in salt-free form. Salt-free aqueous solutions of polymers comprising vinylamine units can be prepared, for example, from the salt-containing polymer solutions described above, by means of ultrafiltration through suitable membranes having cutoffs of, for example, 1000 to 500 000 daltons, preferably 10 000 to 300 000 daltons.

Derivatives of polymers comprising vinylamine units can also be used. Thus, for example, it is possible to prepare a multiplicity of suitable derivatives from the polymers comprising vinylamine units, by amidation, alkylation, sulfonamide formation, urea formation, thiourea formation, carbamate formation, acylation, carboxymethylation, phosphonomethylation or Michael addition of the amino groups of the polymer. Of particular interest in this context are uncrosslinked polyvinylguanidines, which are obtainable by reacting polymers comprising vinylamine units, preferably polyvinylamines, with cyanamide ($R^1R^2N$—CN, where $R^1$ and $R^2$=H, $C_1$ to $C_4$ alkyl, $C_3$ to $C_6$ cycloalkyl, phenyl, benzyl, alkyl-substituted phenyl or naphthyl), cf. U.S. Pat. No. 6,087,448, column 3, line 64 to column 5, line 14.

The polymers comprising vinylamine units also include hydrolyzed graft polymers of, for example, N-vinylformamide onto polyalkylene glycols, polyvinyl acetate, polyvinyl alcohol, polyvinylformamides, polysaccharides such as starch, oligosaccharides or monosaccharides. The graft polymers are obtainable by subjecting, for example, N-vinylformamide to free-radical polymerization in aqueous medium in the presence of at least one of the stated grafting bases together if appropriate with other, copolymerizabie monomers, and subsequently subjecting the grafted-on vinylformamide units to conventional hydrolysis, to give vinylamine units.

Among suitable polymers comprising vinylamine units, preference is given to vinylamine homopolymers of N-vinylformamide having a degree of hydrolysis of 1 to 100 mol %, preferably 25 to 100 mol %, and to N-vinylformamide copolymers hydrolyzed to an extent of 1 to 100 mol %, preferably 25 to 100 mol %, and vinyl formate, vinyl acetate, vinyl propionate, acrylonitrile, methyl acrylate, ethyl acrylate and/or methyl methacrylate, and having K values of 30 to 150, in particular 60 to 100. Particular preference is given to using the aforementioned homopolymers of N-vinylformamide in the process of the invention.

Typical representatives of these homopolymers of N-vinylformamide are known under the trade names Catiofast® VFH, Catiofast® VSH and Catiofast® VMP from BASF Aktiengesellschaft.

It will be appreciated that mixtures of said cationic and/or amphoteric polymers can also be used in the process of the invention. It is, however, preferred to use representatives of one polymer class. In particular, polymers comprising vinylamine units are used in the process of the invention.

The cationic and/or amphoteric polymers for use in the process of the invention are added to the fiber suspension in an amount of 0.0001% to 1% by weight, based on the solids content of the paper stock suspension, preferably from 0.0005% to 0.5%, more preferably in an amount of 0.001% to 0.2%, and in particular in an amount of 0.005% to 0.1%, by weight, based in each case on. the solids content of the paper stock suspension.

The addition of said at least one cationic and/or amphoteric polymer to the fiber suspension produces a level of filler retention which is increased enormously in comparison with the prior art; in other words, papers with a high filler content can be produced by the process of the invention. As a result, the fiber fraction in production is reduced, leading to a reduction in the paper's production costs.

As well as the increased filler content, moreover, the papers produced by the process of the invention have an improved dry strength. This is demonstrated in particular by properties such as dry breaking length, tear propagation energy, internal strength, and bending stiffness.

Besides the increase in filler with no change in strength properties, the inventive treatment of the fillers also has the capacity to effect a significant rise in the gloss of the paper. This applies in particular to mechanical papers such as SC paper, for example. Here, the increased gloss denotes an increase in the quality of the paper, which allows the papermaker to obtain a higher selling price.

The finely divided fillers for use in the process of the invention are known from the literature. They comprise finely divided fillers at least partly coated with water-soluble amphoteric copolymers. Aqueous slurries of this kind are known from JP-A 08059740, WO 04/087818 and the file reference DE 103 34 133 A1. Those references are hereby expressly incorporated by reference. The water-soluble amphoteric copolymers disclosed in those references have the common structural feature that they comprise amidine units, both five-membered and six-membered units.

As described above, not only finely divided fillers alone, i.e., in pure form or is what is referred to as fresh filler, but also raw materials comprising finely divided fillers, such as the broke, as it is known, from coated paper, and also mixtures thereof in any desired composition, are comprehended by the term "components comprising finely divided fillers".

By way of example, in the process of the invention, use is made of aqueous slurries of 100% fresh filler, based on the filler fraction.

Alternatively it is also possible in the process of the invention to use aqueous slurries whose filler fraction is obtained 100% from the broke from coated paper. Whether this is the broke from paper coated on one side or on both sides is unimportant.

In a third variant of the process of the invention, aqueous slurries are used of mixtures, in any desired composition, of fresh filler and of broke from coated paper. A mixture of this kind may be composed, for example, of 90% fresh filler and 10% filler from the broke from coated paper, based in each case on the filler content of the aqueous slurry. The proportion may also be the converse: that is, the proportion of fresh filler to filler from the broke from coated paper may be 10%:90%.

Possible mixtures of fresh filler to filler from the broke from coated paper are, for example, 15%:85%, 20%:80%, 30%:70%, 40%:60%, 50%:50%, 60%:40%, 70%:30%, 80%: 20%, and 85%: 15%. As described above, however, mixtures are possible in any desired composition.

Preference is given to using mixtures which have a mixing ratio in the range from 10% (fresh filler):90% (filler from the broke from coated paper) to 90% (fresh filler): 10% (filler from the broke from coated paper).

More preferably the mixing ratio is in the range from 15% (fresh filler):85% (filler from the broke from coated paper) to 60% (fresh filler):40% (filler from the broke from coated paper).

The percentages are based in each case on the total amount of filler in the aqueous slurry.

As the basis for the filler suitability is possessed by, for example, calcium carbonates, present in the form of ground lime (GCC), lime, chalk, or marble, or in the form of precipitated calcium carbonate (PCC). Talc, kaolin, bentonite, satin white, calcium sulfate, barium sulfate and titanium dioxide may likewise be used as fillers. It will be appreciated that mixtures of two or more of the aforementioned fillers may also be used. The particle diameter of the fillers is preferably below 2 μm; for example, between 40% and 90% of the filler particles are situated below a diameter of <2 μm.

In the case of the processes described in JP-A 08059740, WO 04/087818 and DE 103 34 133 A1, the fillers are present in the form of aqueous slurries. Precipitated calcium carbonate is normally in the form of an aqueous slurry in the absence of dispersants. To prepare aqueous slurries of the other fillers (e.g., GCC), it is usual to use an anionic dispersant, e.g., polyacrylic acid having an average molar mass $M_w$ of, for example, 1000 to 40 000 daltons. Where the fillers comprise a high solids content (60% or more, for example), they are ground in the presence of one such anionic dispersant. If an anionic dispersant is used it is employed in an amount, for example, of 0.01% to 0.6%, preferably 0.2%-0.5%, by weight in order to prepare aqueous filler slurries. The slurries dispersed in water in the presence of anionic dispersants comprise for example 10%-60%, in the majority of cases 15%-50%, by weight of at least one filler.

The water-soluble amphoteric polymers described in JP-A 08059740, WO 04/087818and DE 103 34 133 A1 are mixed into the aqueous slurries. For example, an aqueous slurry comprising 1% to 60% by weight of at least one finely divided filler can be admixed with 0.1% to 5% by weight, based on fillers, of a water-soluble amphoteric polymer according to JP-A 08059740, WO 04/087818 and DE 103 34 133 A1, or an aqueous slurry of a finely divided filler can be introduced into an aqueous solution of an amphoteric polymer, and the components mixed in each case.

This treatment of the aqueous slurry of finely divided fillers with the amphoteric polymers can be implemented continuously or batchwise. Preferably the treatment of the fillers with the amphoteric polymer takes place in a continuous mode. For that purpose, for example, the amphoteric polymer can be mixed in as a dilute solution between the filler tank and the filler pump. The dilution and the shearing forces in the filler pump guarantee effective mixing of the filler with the polymer. As a result the finely divided fillers are at least partly coated or impregnated with the water-soluble amphoteric polymers. The solids content of the dilute polymer solution of the water-soluble amphoteric polymers car, amount to between 20% by weight and 0.01% by weight.

When using finely divided fillers obtained from the broke from coated paper, the treatment with the water-soluble amphoteric copolymers may take place, for example, in a way which involves the broke from coated paper being disintegrated in the presence of the water-soluble amphoteric copolymers.

Alternatively the treatment with water-soluble amphoteric copolymers takes place after the broke from coated paper has been disintegrated.

Irrespective of the mode of treatment of the filler from the broke, finely divided fillers are likewise obtained that are at least partly coated or impregnated with water-soluble amphoteric copolymers.

From the filler pump the polymer-treated filler slurry enters immediately into the high-consistency pulp or the low-consistency pulp in the paper machine. Consideration may also be given to metering the treated filler both in the high-consistency pulp and in the low-consistency pulp in the paper machine.

The process of the invention is suitable for producing both chemical papers and mechanical papers. In all cases the process of the invention leads to a significant increase in the filler content of the paper without occasioning significant losses in other paper properties such as dry strength. The filler content is increased without a loss in strength by adding the at least one cationic and/or amphoteric polymer.

The production of paper, board and cardboard by the process of the invention is normally accomplished by draining a slurry of cellulose fibers. Suitable cellulose fibers include all types customary for the purpose, examples being cellulose fibers from mechanical pulp, and fibers obtained from all annual plants. Mechanical pulp includes, for example, groundwood, thermomechanical pulp (TMP), chemothermomechanical pulp (CTMP), pressure groundwood, semichemical pulp, high-yield chemical pulp and refiner mechanical pulp (RMP), and also wastepaper. Also suitable are chemical pulps, which may be used in bleached or unbleached form. Examples of these are sulfate, sulfite and soda pulps. Preference is given to using bleached chemical pulps, also referred to as bleached kraft pulp. Said fibers may be used alone or in a mixture.

The present invention likewise provides papers which are produced in the presence of an aqueous slurry of components comprising finely divided fillers at least partly coated with water-soluble amphoteric copolymers with the addition, further to the aqueous slurry of components comprising finely divided fillers, of at least one cationic and/or amphoteric polymer to the fiber suspension prior to sheet forming.

These papers are notable in particular for a high filler content and a high dry strength. High filler content papers in the sense of the present invention are understood to mean in particular those papers which have a filler content of 3% to 45% by weight, based on the solids content of the paper stock suspension, preferably from 10% to 45% by weight, more preferably from 15% to 40% by weight, and with particular preference from 20% to 35% by weight, based in each case on the solids content of the paper stock suspension.

The invention is illustrated with reference to the following, nonlimiting examples.

The percentages in the examples are weight percentages unless the context suggests otherwise. The electrophoretic mobility or zeta potential was determined by a laser-optical method. For electrophoresis measurements the samples were diluted using an aqueous KCl solution (e.g., 10 mmol) to a concentration for measurement of 1% by volume. The measuring instrument used was the Zetasizer 3000 HS from Malvern Instruments Ltd.

The molar masses $M_w$ of the polymers were determined with the aid of static light scattering. The measurements were carried out at a pH of 7.6 in a 10 millimolar aqueous sodium chloride solution.

The K values were determined by the method of H. Fikentscher, Cellulosechemie, Volume 13, 48-64 and 71-74 (1932) in 1.0% strength aqueous sodium chloride solution at 25° C., a pH of 7 and a polymer concentration of 0.1% by weight.

Fillers used were precipitated chalk, precipitated calcium carbonate (PCC), ground chalk (GCC), kaolin or mixtures of said fillers. In the examples according to the invention five different copolymer-pretreated fillers were used.

The structural composition of these copolymers was determined from the monomer mixture used, from the degree of hydrolysis, and on the basis of $^{13}C$ NMR spectroscopy with reference to the calculation disclosed in the prior German patent application with the file reference 103 34 133.1 and also in WO 04/087818. The signals of the carbon atoms were integrated. $D_2O$ was used as solvent.

I. Use of Fresh Filler

Filler 1

6 g of a 12% strength aqueous solution of an amphoteric copolymer containing 40 mol % vinylformamide units, 30 mol % acrylic acid units and 30 mol % vinylamine and amidine units and having a molecular weight $M_w$ of approximately 500 000 were charged to a glass beaker and subsequently diluted with 30 g of water. Subsequently 150 g of a 20% slurry of precipitated calcium carbonate (PCC) in water were added. During and after the addition of the PCC slurry the mixture was stirred using a Heiltof stirrer at 1000 revolutions per minute (rpm). The pH of the mixture was subsequently adjusted to 8.5. Microelectrophoresis was used to measure the mobility of the filler particles at pH values of 8.5 and 7. At both pH settings the electrophoretic mobility took on a slightly negative value.

Filler 2

6 g of a 12% strength aqueous solution of an amphoteric copolymer containing 40 mol % vinylformamide units, 30 mol % acrylic acid units and 30 mol % vinylamine and amidine units and having a molecular weight $M_w$ of approximately 500 000 were charged to a glass beaker and subsequently diluted with 30 g of water. Subsequently 150 g of a 20% slurry of ground calcium carbonate (GCC) in water were added. The GCC was ground in a laboratory pigment mill in the presence of a dispersant containing sodium acrylate. After grinding, approximately 75% of the GCC particles had a size <2 μm. During and after the addition of the GCC slurry the mixture was stirred using a Heiltof stirrer at 1000 revolutions per minute (rpm). The pH of the mixture was subsequently adjusted to 8.5. Microelectrophoresis was used to measure the mobility of the filler particles at pH values of 8.5 and 7. At both pH settings the electrophoretic mobility took on a slightly negative value.

Filler 3

5.4 g of a 13.5% strength aqueous solution of an amphoteric copolymer prepared according to Example 1 of the prior German patent application with the file reference 103 34 133.1 and containing 35 mol % vinylformamide units, 30 mol % vinylamine and amidine units, 11 mol % sodium vinylsulfonate units and 27 mol % sodium acrylate units and having a molecular weight $M_w$ of approximately 500 000 were charged to a glass beaker and subsequently diluted with 30 g of water. Subsequently 150 g of a 20% slurry of ground calcium carbonate (GCC, Hydrocarb® 60 GU from Omya) in water were added. During and after the addition of the GCC slurry the mixture was stirred using a Heiltof stirrer at 1000 revolutions per minute (rpm). The pH of the mixture was subsequently adjusted to 8.5. Microelectrophoresis was used to measure the mobility of the filler particles at pH values of 8.5 and 7. At both pH settings the electrophoretic mobility took on a slightly negative value.

Filler 4

6 g of a 12% strength aqueous solution of an amphoteric copolymer containing 40 mol % vinylformamide units, 30 mol % acrylic acid units and 30 mol % vinylamine and amidine units and having a molecular weight $M_w$ of approximately 500 000 were charged to a glass beaker and subsequently diluted with 30 g of water. Subsequently 150 g of a 20% slurry of kaolin/clay mixture in water were added. During and after the addition of this slurry the mixture was stirred using a Heiltof stirrer at 1000 revolutions per minute (rpm). The pH of the mixture was subsequently adjusted to 8.5. Microelectrophoresis was used to measure the mobility of the filler particles at pH values of 8.5 and 7. At both pH settings the electrophoretic mobility took on a slightly negative value.

Filler 5 (According to Example 1 of JP-A 08059740)

6 g of a 12% strength aqueous solution of an amphoteric copolymer containing 35 mol % amidine units of structure (I), 20 mol % vinylformamide units, 10 mol % vinylamine units, 5 mol % acrylic acid units and 30 mol % nitrile units and having a molar mass $M_w$ of 300 000 daltons were charged to a glass beaker and subsequently diluted with 30 g of water. The intrinsic viscosity of the polymers was 2.7 dl/g (measured with an Oswald viscometer in an aqueous NaCl solution with an NaCl content of 0.1 g/dl at a temperature of 25° C. Subsequently 150 g of a 20% slurry of precipitated calcium carbonate (PCC) in water were added. During and after the addition of the slurry the mixture was stirred using a Heiltof stirrer at 1000 revolutions per minute (rpm). The pH of the mixture was subsequently adjusted to 8.5. Microelectrophoresis was used to measure the mobility of the filler particles at pH values of 8.5 and 7. At both pH settings the electrophoretic mobility took on a slightly negative value.

Production of Paper Sheets of Type A

EXAMPLES 1 to 5

A mixture of TMP (thermomechanical pulp) and ground wood in a ratio of 70/30 and with a solids concentration of 4% was beaten speck-free in a laboratory pulper until a freeness of 60-85 was reached. The pH of the stock was in the range between 7 and 8. The beaten stock was then diluted by adding water to a solids concentration of 0.35%.

In order to determine the behavior of the aqueous filler slurries described above, comprising the pretreated fillers in combination with polymers comprising vinylamine units, in the production of filler paper, 500 ml of each paper stock suspension were introduced initially, and each of the slurries of the pretreated fillers and a polymer comprising vinylamine units (Catiofast® VMP) were metered into this pulp. The metering amount of the polymers comprising vinylamine units was 0.1% of polymer in each case, based on the solids content of the paper stock suspension. Immediately thereafter a cationic polyacrylamide retention aid (Polymin® KE 2020) was metered into this mixture. The metering amount of the retention aid was 0.01% of polymer in each case, based on the solids content of the paper stock suspension.

With the aid of a number of preliminary experiments the amount of slurry was adjusted so that the amount of pretreated filler was approximately 20%.

The paper sheets were each produced on a Rapid-Köthen sheet former according to ISO 5269/2 with a sheet weight of 80 g/m$^2$, subsequently dried at 90° C. for 7 minutes and then calendered with a nip pressure of 200 N/cm.

COMPARATIVE EXAMPLES 6 to 10

Paper sheets were produced in the same way as for Examples 1 to 5 with the corresponding pretreated fillers. However, no polymers comprising vinylamine units were added.

COMPARATIVE EXAMPLES 11 to 14

Paper sheets were produced in the same way as for Comparative Examples 6 to 9, but in addition the corresponding fillers were used in untreated form, i.e., free from amphoteric copolymers. The amount of filler slurry added during sheet forming, however, was increased so as to attain the equivalent filler content of the respective filler type from Examples 1 to 4.

Testing of the Paper Sheets of Type A

Following a period of storage in a climate-controlled chamber at a constant 23° C. and 50% humidity for 12 hours, the dry breaking length of the sheets according to DIN 54540, the Brecht-Imset tear propagation energy (DIN 53115) and the bending stiffness according to DIN 53121 were determined. The results are reported in Table 1.

TABLE 1

| | Slurry with filler | Dry breaking length [m] | Tear propagation energy [mNm/m] | Bending stiffness [mN] | Filler content [%] |
|---|---|---|---|---|---|
| Example | | | | | |
| 1 | Filler 1 | 2876 | 588 | 40.1 | 33.8 |
| 2 | Filler 2 | 2456 | 575 | 39.4 | 31.3 |
| 3 | Filler 3 | 2567 | 588 | 38.7 | 30.8 |
| 4 | Filler 4 | 3256 | 625 | 37.9 | 29.8 |
| 5 | Filler 5 | 2689 | 362 | 38.1 | 28.7 |
| Comparative examples | | | | | |
| 6 | Filler 1 | 2601 | 544 | 36.5 | 27.1 |
| 7 | Filler 2 | 2381 | 556 | 37.9 | 25.9 |
| 8 | Filler 3 | 2451 | 588 | 39.3 | 25.7 |
| 9 | Filler 4 | 3023 | 575 | 36.3 | 24.2 |
| 10 | Filler 5 | 2412 | 625 | 36.1 | 23.6 |
| 11 | PCC slurry (as for filler 1) without pretreatment | 1281 | 306 | 19.4 | 34.6 |
| 12 | GCC slurry (as for filler 2) without pretreatment | 1198 | 337 | 20.6 | 32.1 |
| 13 | GCC slurry (as for filler 3) without pretreatment | 1314 | 350 | 22.2 | 30.8 |
| 14 | Kaolin/clay slurry (as for filler 4) without pretreatment | 1368 | 612 | 17.3 | 31.3 |

Production of Paper Sheets of Type B

EXAMPLES 15 to 18

A mixture of bleached birch sulfate and bleached pine sulfite in a ratio of 70/30 and with a solids concentration of 4% was beaten speck-free in a laboratory pulper until a freeness of 55-60 was reached. Thereafter an optical brightener (Blankophor® PSG) and a cationic starch (HiCat® 5163 A) were added to the beaten stock. The digestion of the cationic starch was carried out in the form of a 10% starch slurry in a jet digester at 130° C. with a residence time of 1 minute. The metering amount of the optical brightener was 0.5% of commercial product, based on the solids content of the paper stock suspension. The metering amount of the cationic starch was 0.5% starch, based on the solids content of the paper stock suspension. The pH of the stock was in the range between 7 and 8. The beaten stock was then diluted by adding water to a solids concentration of 0.35%.

In order to determine the behavior of the aqueous filler slurries described above, comprising the pretreated fillers in combination with polymers comprising vinylamine units, in the production of filler paper, 500 ml of each paper stock suspension were introduced initially, and each of the slurries of the pretreated fillers and a polymer comprising vinylamine units (Catiofast® VFH) was metered into this pulp. The metering amount of the polymer comprising vinylamine units was 0.1% of polymer in each case, based on the solids content of the paper stock suspension. Immediately thereafter a cationic polyacrylamide retention aid (Polymin® KE 2020) was metered into this mixture. The metering amount of the retention aid was 0.01% of polymer in each case, based on the solids content of the paper stock suspension.

With the aid of a number of preliminary experiments the amount of slurry was adjusted so that the amount of pretreated filler was approximately 16%.

The paper sheets were each produced on a Rapid-Köthen sheet former according to ISO 5269/2 with a sheet weight of 80 g/m$^2$, and then dried at 90° C. for 7 minutes and subsequently calendered with a nip pressure of 200 N/cm.

COMPARATIVE EXAMPLES 19 to 22

Paper sheets were produced in the same way as for Examples 15 to 18 with the corresponding pretreated fillers. However, no polymers comprising vinylamine units were added.

COMPARATIVE EXAMPLES 23 to 25

Paper sheets were produced in the same way as for Comparative Examples 19 to 21, but in addition the corresponding fillers were used in untreated form, i.e., free from amphoteric copolymers. The amount of filler slurry added during sheet forming, however, was increased so as to attain the equivalent filler content of the respective filler type from Examples 15 to 17.

Testing of the Paper Sheets of Type B

Following a period of storage in a climate-controlled chamber at a constant 23° C. and 50% humidity for 12 hours, the internal strength according to DIN 54516 and the dry breaking length of the sheets according to DIN 54540 were determined. The tear propagation energy was determined by the Brecht-Imset method (DIN 53115) and the bending stiffness according to DIN 53121 The results are reported in Table 2.

TABLE 2

| | Slurry with filler | Internal strength [N/m] | Dry breaking length [m] | Tear propagation energy [mNm/m] | Bending stiffness [mN] | Filler content [%] |
|---|---|---|---|---|---|---|
| Example | | | | | | |
| 15 | Filler 1 | 222 | 4768 | 775 | 38.5 | 30.3 |
| 16 | Filler 2 | 203 | 4867 | 781 | 37.6 | 28.9 |
| 17 | Filler 3 | 214 | 4754 | 775 | 40.4 | 27.4 |
| 18 | Filler 5 | 165 | 4345 | 750 | 36.1 | 28.5 |
| Comparative examples | | | | | | |
| 19 | Filler 1 | 201 | 4483 | 750 | 36.1 | 23.9 |
| 20 | Filler 2 | 187 | 4536 | 750 | 37.3 | 21.8 |
| 21 | Filler 3 | 191 | 4489 | 775 | 39.8 | 22.7 |
| 22 | Filler 5 | 168 | 4291 | 775 | 34.5 | 22.5 |
| 23 | PCC slurry (as filler 1) without pretreatment | 91 | 2876 | 350 | 18.2 | 30.8 |
| 24 | GCC slurry (as filler 2) without pretreatment | 99 | 2965 | 350 | 19.1 | 29.5 |
| 25 | GCC slurry (as for filler 3) without pretreatment | 103 | 3173 | 375 | 20.5 | 28.6 |

Production of Paper Sheets of Type C

EXAMPLE 28

A mixture of bleached chemical pulp and ground wood in a ratio of 20/80 and with a solids concentration of 4% was beaten speck-free in a laboratory pulper until a freeness of 55-60 was reached. The pH of the stock was in the range between 7 and 8. The beaten stock was then diluted by adding water to a solids concentration of 0.35%.

Subsequently 500 ml of the paper stock suspension were introduced initially, and a slurry of filler 2 was metered into this pulp. In addition, a 20% by weight slurry of an untreated kaolin/clay mixture was metered in. Immediately thereafter a cationic polyacrylamide retention aid (Polymin® KE 2020) was metered into this mixture. The metering amount of the retention aid was 0.01% of polymer, based on the solids content of the paper stock suspension.

With the aid of a number of preliminary experiments the amount of the metered slurry of filler 2 and of the untreated kaolin/clay mixture was adjusted so that the amount of filler 2 and of untreated kaolin/clay was approximately 20%. The total filler content was therefore approximately 40%.

The paper sheets were produced on a Rapid-Köthen sheet former according to ISO 5269/2 with a sheet weight of 80 g/m$^2$, subsequently dried at 9020 for 7 minutes and then calendered with a nip pressure of 200 N/cm.

COMPARATIVE EXAMPLE 27

Paper sheets were produced in the same way as for Example 26. The corresponding filler was used in untreated form, i.e., free from amphoteric copolymers. The amount of filler slurry added during sheet forming, however, was increased so as to attain the equivalent filler content of the respective filler type from Example 26.

Testing of the Paper Sheets of Type C

Following a period of storage in a climate-controlled chamber at a constant 23° C. and 50% humidity for 12 hours, the dry breaking length of the sheets according to DIN 54540 and the Lehmann gloss of the paper sheets at an angle of 75° (DIN EN ISO 8254-2) were determined. The dry pick resistance of the paper sheets was determined using the ITG printability tester (ISO 3783). The results are reported in Table 3.

TABLE 3

| | Slurry with filler | Dry breaking length [m] | Gloss OS [%] | Gloss SS [%] | IGT |
|---|---|---|---|---|---|
| Example | | | | | |
| 26 | Filler 2 | 2956 | 47.3 | 48.9 | very good |
| Comparative example | | | | | |
| 27 | GCC slurry (as for filler 2) without pretreatment | 2534 | 42.5 | 44.1 | moderate |

II. Use of Filler from the Broke from Coated Paper

The double-sidedly coated wood-free paper used in the examples, with a basis weight of 104 g/m$^2$, comprised, according to analysis of the ashing data (500° C. for 2 hours in an ashing oven), a total of 38.4% filler. According to the papermaker, the base paper used for producing the coated grade was produced with a filler content of approximately 23% (ground calcium carbonate, GCC). The coat weight on each side was 12 g/m$^2$. The coating pigment used was precipitated calcium carbonate.

EXAMPLES 28-31

Production of the Coated Broke

In a 30-liter vessel, 500 g of the coated paper were softened with 12 liters of water for 5 minutes. Then 5 g of a 12% strength aqueous solution of an amphoteric copolymer containing 40 mol % vinylformamide units, 30 mol % acrylic acid units and 30 mol % vinylamine and amidine units and having a molecular weight $M_w$ of approximately 500 000 were added. Thereafter the mixture was beaten speck-free in a laboratory pulper (from Escher Wyss) for 10 minutes. The freeness of the beaten pulp suspension thereafter was 65 Schopper Riegler.

Production of Paper Sheets of Type D

A mixture of bleached birch sulfate and bleached pine sulfite in a ratio of 70/30 and with a solids concentration of 4% was beaten speck-free in a laboratory pulper until a freeness of 55-60 was reached. The beaten pulp and the coated broke beaten in the presence of the amphoteric copolymer were mixed in a ratio of 1:1. Thereafter an optical brightener (Blankophor® PSG) and a cationic starch (HiCat® 5163 A) were added to the total pulp. The digestion of the cationic starch was carried out in the form of a 10% starch slurry in a jet digester at 130° C. with a residence time of 1 minute. The metering amount of the optical brightener was 0.5% of commercial product, based on the solids content of the paper stock suspension. The metering amount of the cationic starch was 0.5% starch, based on the solids content of the paper stock suspension. The pH of the stock was in the range between 7 and 8. The total stock was then diluted by adding water to a solids concentration of 0.35%.

To produce filled paper, 500 ml of each paper stock suspension were introduced to start with and in each case 1.5 g (Example 28), 2 g (Example 29), 2.5 g (Example 30), and 3 g (Example 31) of a 20% GCC slurry (Hydrocarb® 60 GU from Omya) and also in each case 0.05% of a polymer comprising vinylamine units (Catiofast® VFH) were metered in, based on the solids content of the paper stock suspension. Immediately thereafter a cationic polyacrylamide retention aid (Polymin® KE 2020) was metered into this mixture. The metering amount of the retention aid was 0.01% of polymer in each case, based on the solids content of the paper stock suspension.

The paper sheets were each produced on a Rapid-Köthen sheet former according to ISO 5269/2 with a sheet weight of 80 g/m$^2$, subsequently dried at 90° C. for 7 minutes and then calendered with a nip pressure of approximately 200 N/cm.

EXAMPLES 32-35

Production of the Coated Broke

In a 30-liter vessel, 500 g of the coated paper were softened with 12 liters of water for 5 minutes. Then 5 g of a 12% strength aqueous solution of an amphoteric copolymer containing 40 mol % vinylformamide units, 30 mol % acrylic acid units and 30 mol % vinylamine and amidine units and having a molecular weight $M_w$ of approximately 500 000 were added. Thereafter the mixture was beaten speck-free in a laboratory pulper (from Escher Wyss) for 10 minutes. The freeness of the beaten pulp suspension thereafter was 65 Schopper Riegler.

500 g of the coated paper were beaten speck-free with 12 liters of water (stock density 4%) in a laboratory pulper (from Escher Wyss) for 10 minutes. The freeness of the beaten stock suspension was 65 Schopper Riegler. Subsequently the beaten broke was admixed with 5 g of a 12% strength aqueous solution of an amphoteric copolymer containing 40 mol % vinylformamide units, 30 mol % acrylic acid units and 30 mol % vinylamine and amidine units and having a molecular weight $M_w$ of approximately 500 000.

Production of Paper Sheets of Type E

A mixture of bleached birch sulfate and bleached pine sulfite in a ratio of 70/30 and with a solids concentration of 4% was beaten speck-free in a laboratory pulper until a freeness of 55-60 was reached. The beaten pulp and the coated broke beaten in the presence of the amphoteric copolymer were mixed in a ratio of 1:1. Thereafter an optical brightener (Blankophor® PSG) and a cationic starch (HiCat® 5163 A) were added to the total pulp. The digestion of the cationic starch, was carried out in the form of a 10% starch slurry in a let digester at 130° C. with a residence time of 1 minute. The metering amount of the optical brightener was 0.5% of commercial product, based on the solids content of the paper stock suspension. The metering amount of the cationic starch was 0.5% starch, based on the solids content of the paper stock suspension. The pH of the stock was in the range between 7 and 8. The total stock was then diluted by adding water to a solids concentration of 0.35%, To produce filled paper, 500 ml of each paper stock suspension were introduced to start with and in each case 1.5 g (Example 32), 2 g (Example 33), 2.5 g (Example 34), and 3 g (Example 35) of a 20% GCC slurry (Hydrocarb® 60 GU from Omya) and also in each case 0.05% of a polymer comprising vinylamine units (Catiofast® VFH) were metered in, based on the solids content of the paper stock suspension. Immediately thereafter a cationic polyacrylamide retention aid (Polymin® KE 2020) was metered into this mixture. The metering amount of the retention aid was 0.01% of polymer in each case, based on the solids content of the paper stock suspension.

The paper sheets were each produced on a Rapid-Köthen sheet former according to ISO 5269/2 with a sheet weight of 80 g/m$^2$, subsequently dried at 90° C. for 7 minutes and then calendered with a nip pressure of approximately 200 N/cm.

COMPARATIVE EXAMPLES 36-39

Production of the Coated Broke 500 g of the coated paper were beaten speck-free with 12 liters of water (stock density 4%) in a laboratory pulper (from Escher Wyss) for 10 minutes. The freeness of the beaten stock suspension thereafter was 65 Schopper Riegler.

Production of Paper Sheets of Type F

A mixture of bleached birch sulfate and bleached pine sulfite in a ratio of 70/30 and with a solids concentration of 4% was beaten speck-free in a laboratory pulper until a freeness of 55-60 was reached. The beaten pulp and the coated broke were then mixed in a ratio of 1:1, Thereafter an optical brightener (Blankophor® PSG) and a cationic starch (Hi-Cat® 5163 A) were added to the total pulp. The digestion of the cationic starch was carried out in the form of a 10% starch slurry in a jet digester at 130° C. with a residence time of 1 minute. The metering amount of the optical brightener was 0.5% of starch, based on the solids content of the paper stock suspension. The metering amount of the cationic starch was 0.5% starch, based on the solids content of the paper stock suspension. The pH of the stock was in the range between 7 and 8. The total stock was then diluted by adding water to a solids concentration of 0.35%.

To produce filled paper, 500 ml of each paper stock suspension were introduced to start with and in each case 1.5 g (Comparative Example 36), 2 g Comparative Example 37), 2.5 g (Comparative Example 38), and 3 g (Comparative Example 39) of a 20% GCC slurry (Hydrocarb® 60 GU from Omya) and also in each case 0.05% of a polymer comprising vinylamine units (Catiofast® VFH) were metered into this pulp, based on the solids content of the paper stock suspension. Immediately thereafter a cationic polyacrylamide retention aid (Polymin® KE 2020) was metered into this mixture. The metering amount of the retention aid was 0.01% of polymer in each case, based on the solids content of the paper stock suspension.

The paper sheets were each produced on a Rapid-Köthen sheet former according to ISO 5269/2 with a sheet weight of 80 g/m$^2$, subsequently dried at 90° C. for 7 minutes and then calendered with a nip pressure of approximately 200 N/cm.

Testing of the Paper Sheets of Type D, E, F

Following a period of storage in a climate-controlled chamber at a constant 23° C. and 50% humidity for 12 hours, the dry breaking length of the sheets according to DIN 54540 and the internal strength according to DIN 54516 were determined. The results are reported in Table 4.

TABLE 4

| | Dry breaking length [m] | Internal strength [N/m] | Filler content [%] |
|---|---|---|---|
| Example | | | |
| 28 | 4465 | 143 | 25.4 |
| 29 | 4198 | 129 | 29.3 |
| 30 | 3867 | 127 | 31.4 |
| 31 | 3554 | 112 | 33.9 |
| 32 | 4312 | 138 | 26.1 |

TABLE 4-continued

| | Dry breaking length [m] | Internal strength [N/m] | Filler content [%] |
|---|---|---|---|
| 33 | 4135 | 131 | 30.3 |
| 34 | 3816 | 116 | 32.6 |
| 35 | 3545 | 109 | 34.2 |
| Comparative Examples | | | |
| 36 | 3564 | 102 | 24.2 |
| 37 | 3421 | 94 | 26.4 |
| 38 | 2987 | 86 | 29.3 |
| 39 | 2534 | 73 | 33.1 |

The invention claimed is:

1. A process for producing a sheet of paper, board or cardboard, comprising:

combining (a) an aqueous suspension comprising fibers, (b) at least one finely divided filler and (c) at least one cationic and/or amphoteric polymer prior to sheet forming, wherein the cationic and/or amphoteric polymer does not contain an ester of an unsaturated carboxylic acid with a quaternized amino alcohol as a structural element, and wherein the finely divided filler is coated at least partly with a water-soluble amphoteric copolymer prior to being combined with the aqueous suspension comprising fibers and the cationic and/or amphoteric polymer.

2. The process according to claim 1, wherein said cationic and/or amphoteric polymer is selected from homo- and copolymers of vinylimidazoles, diallylalkylamines and allyldialkylamines, these monomers being used in neutral form, as salts of acids, or in quaternized form, homo- and copolymers of esters of unsaturated carboxylic acids with N,N-dialkylamino alcohols or N-alkylamine alcohols, these monomers being used in neutral form or as salts of acids, homo- and copolymers of amides of unsaturated carboxylic acids with N,N-dialkyldiamines or N-alkyldiamines, these monomers being used in neutral form, as salts of acids, or in quaternized form, condensation products of epichlorohydrin or bisepoxides with dialkylamines or polyamidoamines, polyethyleneimines, grafting products of ethyleneimines onto amidoamines or polyamines, cationic starches and/or polymers comprising vinylamine units.

3. The process according to claim 1, wherein said polymer is a polymer comprising vinylamine units.

4. The process according to claim 3, wherein said polymer comprising vinylamine units comprises N-vinylformamide homo- and copolymers hydrolyzed to the extent of 1 to 100 mol %.

5. The process according to claim 4, wherein said polymers are N-vinylformamide homopolymers.

6. The process according to claim 4, wherein said polymers are copolymers comprising 95 to 5 mol % of N-vinylformamide and 5 to 95 mol % of monoethylenically unsaturated monomers.

7. The process according to claim 6, wherein said monoethylenically unsaturated monomers are selected from vinyl formate, vinyl acetate, acrylonitrile, methyl acrylate, ethyl acrylate and methyl methacrylate.

8. The process according to claim 1, wherein said at least one cationic and/or amphoteric polymer is added to the fiber suspension immediately after the addition of the aqueous slurry of components comprising finely divided fillers.

9. The process according to claim 1, wherein said at least one cationic and/or amphoteric polymer is added to the fiber suspension in an amount of 0.0001% to 1% by weight, based on the solids content of the paper stock suspension.

10. The process according to claim 1, wherein the water-soluble amphoteric copolymers comprise amidine units.

11. Paper produced by the process of claim 1.

12. The paper according to claim 11, wherein the filler content is 3% to 45% by weight, based on the solids content of the paper stock suspension.

13. The process of claim 1, further comprising forming a sheet of paper, board or cardboard.

14. A process for producing a sheet of paper, board or cardboard, comprising:

at least partially coating at least one finely divided filler with a water-soluble amphoteric copolymer prior, followed by combining (a) an aqueous suspension comprising fibers, (b) the coated finely divided filler and (c) at least one cationic and/or amphoteric polymer prior to sheet forming, wherein the cationic and/or amphoteric polymer does not contain an ester of an unsaturated carboxylic acid with a quaternized amino alcohol as a structural element.

15. The process of claim 1, wherein (c) is a cationic polymer.

16. The process of claim 1, wherein an aqueous slurry containing 1% to 60% by weight of the at least one finely divided filler is combined with 0.1 to 5% by weight, based on the weight of the filler, of the water-soluble amphoteric copolymer.

17. In a process for producing a sheet of paper, board or cardboard, the improvement comprising combining (a) an aqueous suspension comprising fibers, (b) at least one finely divided filler and (c) at least one cationic and/or amphoteric polymer prior to sheet forming, wherein the cationic and/or amphoteric polymer does not contain an ester of an unsaturated carboxylic acid with a quaternized amino alcohol as a structural element, and wherein the finely divided filler is coated at least partly with a water-soluble amphoteric copolymer prior to being combined with the aqueous suspension comprising fibers and the cationic and/or amphoteric polymer.

18. The process of claim 14, further comprising forming a sheet of paper, board or cardboard.

* * * * *